US009283752B2

(12) United States Patent
Klein Koerkamp et al.

(10) Patent No.: US 9,283,752 B2
(45) Date of Patent: Mar. 15, 2016

(54) METHOD FOR PRINTING CONTIGUOUS SWATHS

(71) Applicant: OCE-TECHNOLOGIES B.V., Venlo (NL)

(72) Inventors: Koen Joan Klein Koerkamp, Venlo (NL); Eduard T. H. De Grijs, Venlo (NL); Robert W. M. Severt, Eindhoven (NL); Paul Kuiper, Eindhoven (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/183,164

(22) Filed: Feb. 18, 2014

(65) Prior Publication Data

US 2014/0160191 A1 Jun. 12, 2014

Related U.S. Application Data

(63) Continuation of application No. PCT/EP2012/065102, filed on Aug. 2, 2012.

(30) Foreign Application Priority Data

Aug. 19, 2011 (EP) ..... 11178088

(51) Int. Cl.

| | |
|---|---|
| ***B41J 29/38*** | (2006.01) |
| ***B41J 29/393*** | (2006.01) |
| ***B41J 2/07*** | (2006.01) |
| ***B41J 2/21*** | (2006.01) |
| ***B41J 11/46*** | (2006.01) |

(52) U.S. Cl.
CPC *B41J 2/07* (2013.01); *B41J 2/2132* (2013.01); *B41J 11/46* (2013.01)

(58) Field of Classification Search
CPC ..... B41J 2/2132; B41J 29/393; B41J 2/2135; B41J 2/07; B41J 11/46
USPC ..... 347/5, 9, 12, 14, 19
See application file for complete search history.

(56) References Cited

U.S. PATENT DOCUMENTS

| | | | |
|---|---|---|---|
| 5,384,587 | A | 1/1995 | Takagi et al. |
| 6,540,315 | B1 | 4/2003 | Nystrom et al. |
| 6,547,370 | B2 | 4/2003 | Mantell et al. |
| 7,050,193 | B1 | 5/2006 | Downing |
| 7,686,414 | B2 | 3/2010 | Korem et al. |
| 2002/0126171 | A1 | 9/2002 | Subirada et al. |
| 2003/0058295 | A1 | 3/2003 | Heiles et al. |

FOREIGN PATENT DOCUMENTS

WO WO 2010/054963 A1 5/2010

*Primary Examiner* — Jannelle M Lebron
(74) *Attorney, Agent, or Firm* — Birch, Stewart, Kolasch & Birch, LLP

(57) ABSTRACT

A method for printing an image on an image receiving member is provided, in which a print head having an array of print elements moves in a scanning direction to print image lines and the image receiving member is advanced in a transport direction after printing a swath. In order to obtain various contiguous swaths of print lines without a light or dark line between the swaths, the position of a prior swath printed preceding to a current swath is determined during the printing of the current swath. A digital mask is applied to the print data that is associated with the print elements at the to the prior swath adjoining edge of the current swath in dependence on the determination of the position of the prior swath.

14 Claims, 5 Drawing Sheets

METHOD FOR PRINTING CONTIGUOUS SWATHS

CROSS REFERENCE TO RELATED APPLICATIONS

This application is a Bypass Continuation of PCT International Application No. PCT/EP2012/065102 filed on Aug. 02, 2012, which claims priority under 35 U.S.C §119(a) to Patent Application No. 11178088.8 filed in Europe on Aug. 19, 2011, all of which are hereby expressly incorporated by reference into the present application.

FIELD OF THE INVENTION

The invention relates to a method for printing an image on an image receiving member in a plurality of swaths, each swath being printed by a print head that reciprocates in a scanning direction, the print head being configured to apply marking material to the image receiving material in accordance with image data provided to the print head and the image receiving member being advanced stepwise in a transport direction, which is substantially perpendicular to the scanning direction. The invention further relates to a print system, configured to perform said method.

BACKGROUND OF THE INVENTION

Print processes that employ a print head for printing swaths comprising a number of image lines in a direction perpendicular to a transport direction of an image receiving member, such as, for example, a paper sheet or paper supplied from a roll, rely on an accurate transport of the image receiving member or the print head in order to have different swaths correctly joining each other. An example of such a print process is an inkjet print process wherein an array of nozzles in a print head moves in a scanning direction to apply ink droplets as marking material by activating nozzles according to a digital signal comprising swath image data that is derived from a digital image. The term "print head" will be used for both a single print head comprising an array of print elements and for an assembly or plurality of single print heads that are fixed on a common mechanical structure, such as a carriage.

After making a swath over the full width of the image, or at least part of the full width, the image receiving member is advanced in a transport direction that is substantially perpendicular to the scanning direction in which the print head reciprocates. Equivalently the image receiving member may be fixed and the print head advanced. The advancement is stepwise and after making a paper step, the print process is applied to produce a next swath.

To have the various swaths joining each other contiguously, it is important that the paper step is accurately adjusted to the size of the swaths. If a paper step is too small, marking material, such as ink droplets, in image lines from two swaths will be printed on top of each other which may result in a dark line at the boundary between the two swaths. If a paper step is too large, a light line will appear at this boundary, because a part of the image receiving member will receive no marking material. To diminish the effects of a deviant paper step, a multi-pass strategy may be used wherein each individual paper step is a fraction of the swath width and wherein, in each swath, only part of the marking material that is needed to make up the image on the image receiving member, is applied. This is done at the expense of a diminished productivity. Other so-called print modes involve an interlacing print strategy in which image lines are printed alternated by non-printed lines. When the print head passes the same area again after a paper step, the non-printed lines are printed. This is useful when the integration density of a print head is smaller than the intended printed image line density on the image receiving member. In some print modes, the visibility of a dark or light line at the boundary may be more or less than in other, but in all cases it depends on the amount of overlap of the marking material in the two adjoining swaths.

A well-known method to diminish the visibility of these swath boundary lines is to interweave the swaths by modifying the shape of the swath boundary with a regular or irregular pattern. For this, a digital mask may recurrently be applied to pixels in the image lines at the boundary of a first swath. This digital mask prevents the activation of nozzles and thus the application of marking material in this first swath for at least a part of a number of these image lines from a print element close to an end of a print head up to the last print element at this end of the print head. A complementary digital mask is applied to the adjoining side of a second swath, masking the pixels that were printed in the first swath, thus complementing the image lines partly printed in the first swath. By this technique, the swath boundary is not parallel to the image lines in the swath and a small difference between the paper step and a predetermined distance within a swath will become less annoyingly visible. A small deliberate overlap of a number of image lines in a first swath and a second swath is all that is needed to apply this technique.

In a similar way, this technique may be applied for static staggered print heads extending in a direction perpendicular to the transport direction of the image receiving substrate. In that case, the substrate is transported with a constant speed and the swaths extend in a direction parallel to the transport direction. The swaths are printed simultaneously instead of in sequence. A small overlap between two neighbouring static print heads enables a variation of the boundary between the swaths by the application of complementary digital masks. Thus, even in absence of a paper step, the interweaving of swaths may be used to obfuscate a boundary line between them.

With swaths perpendicular to the medium transport direction, an advancement step or paper step is conventionally applied by a drive roller with encoders to control its rotation. The roller has a hard surface to exclude wear and minimize elasticity effects. Furthermore, the eccentricity of the roller is measured in a calibration and saved in an electronic memory for establishing a relation between the rotation of the roller and the lateral displacement of an image receiving member that is pressed against the surface of the roller. In practice, the actual distance over which the image receiving member is transported may deviate from the required paper step. This deviation is also known as the paper step error. It may result from an inaccurate calibration for a specific image receiving member, but more often the deviation results from changes in the image receiving member due to variation in humidity or temperature. These result in uncontrolled shrinkage or expansion of the image receiving member. A further source for a deviation may be the limited stiffness of the construction, the supporting frame, in which the image receiving member transport takes place as an acceleration or deceleration of the print head may slightly deform the structure in which an accurate fit of the two swaths is intended. The deviation may even not be constant over the whole width, especially when the image receiving member is wide as in the case of billboards, banners or engineering drawings.

In next generation print systems, the swath width and the associated paper step can be expected to increase substantially, because this increases the productivity of these systems. Using known image receiving member transport devices, this leads to an increasing deviation between the paper step or intended transport distance and the actual transport distance. Therefore, it is expected that the problem of an emerging light or dark boundary line at the transition between two swaths will increase. Measures to increase the accuracy are considered to be costly. Besides, there are parameters that are hard to control, such as the expansion of the image receiving member under humid conditions or its shrinkage when heated. Furthermore, it will be increasingly insufficient to apply a single paper step in a print system in the light of a paper step error that varies along the scanning direction.

Several measures are known that reduce the effect of a paper step error. In U.S. Pat. Nos. 5,384,587 and 6,547,370 the density of droplets in the image lines at the edges of a swath is reduced. The density is supplemented by droplets of an adjacent swath with the effect of spreading the deviation over a larger area on the image receiving member. Another approach is taken in U.S. Pat. No. 7,050,193, wherein the edge of a swath is measured to generate a signal to control the position of the print head when printing a next swath. This is similar to the method disclosed in U.S. Pat. No. 7,686,414 for printing on flexible substrates. In the latter case, image position control marks are detected to adapt the position of the image lines that are printed in a swath. This involves either a movement of the print head or a corrective data shift of the image data. In the second case, other print elements or nozzles than the originally intended ones are prepared to print corresponding image lines such that the image position moves relative to the image receiving member.

The known methods only have a limited effect on the reduction of the effects of a paper step error or involve far reaching measures, such as considerable data processing time. Hence, there is a need for an inexpensive, plain method that addresses the problems mentioned above.

SUMMARY OF THE INVENTION

According to the present invention a method for printing an image comprises the steps of preparing first swath image data from the image, the first swath image data comprising image data to print a first swath, printing the first swath using the first swath image data by the application of a selected part of the print head, defining an advancement step for advancing the image receiving member, such that, after application of the advancement step, at least a part of the print head overlaps the first swath, preparing second swath image data from the image, the second swath image data comprising image data to print a second swath and comprising at least a part of the first swath image data, advancing the image receiving member in the transport direction using the advancement step, determining a position of the first swath on the image receiving member relative to the print head position after advancing the image receiving member, defining, in dependence on the determined position, a digital mask that prevents the application of the part of the print head that overlaps the first swath, and printing a second swath with the application of the digital mask on the second swath image data.

In the step of preparing first swath image data, the image is processed in such a way that every print element is associated with an image line in the image. This is usually done during the time a previous swath is printed, because of the significant processing time that is needed. In the processing, the position of the print elements is considered, so, in general, it is not possible to change the relation between the print element and the image line within a short time frame. An advancement step, or paper step, is defined in dependence on the print mode and printed first swath. After applying this paper step, the print head overlaps the first swath in order to have in a second swath a number of print elements associated with image lines that were also associated with other print elements in the first swath. In dependence on a determined relative position of the printed first swath and a current position of the print head, a digital mask that prevents the application of print elements that would apply marking material on positions where already sufficient marking material has been printed, can be defined and applied without extensive calculations. Thus, no dark line appears at the boundary of the swaths. The overlap of the print head also gives the possibility to print some extra image lines, if the distance between the two swaths is too large to completely cover the image receiving material with marking material. In that case the digital mask is defined to prevent the application of a smaller number of print elements. Thus, no light line appears at the boundary of the swaths. Since the processing time for defining and applying a digital mask can be made very short, it is possible to determine the edge of the first swath in dependence on the position of the print head in the scanning direction. In this way, the second swath can be made to follow the edge of the first swath and the two neighbouring swaths can be made to join each other without dark or light line between them. A further advantage is that the side of the second swath that does not adjoin the first swath is unaffected by the application of the digital mask. Therefore, there is no way that irregularities in the edge of the first swath propagate to an edge of the second swath, except where it is necessary to make the edges of the swaths adjoin.

In a further embodiment, the advancement step is based on a measurement of a distance between two swaths. This has the advantage that media for which no calibration of the relation between the rotation and the lateral displacement has taken place, will have a paper step size that is nominally adjusted to the swath width.

In a further embodiment, the digital mask comprises two digital masks that are applied alternately when the part of the print head that overlaps the first swath does not correspond to an integral number of image lines. One of the two digital masks undercompensates the overlap between the swaths, whereas the second of the two digital masks overcompensates the overlap between the swaths. By alternating these two digital masks the average overlap between the swaths is arranged to be close to zero.

In a further embodiment, the determined position of the first swath is used to adapt a position of a digital mask that is applied for interweaving the first and second swath. This has an additional advantage in that, when a pixel in an image line disappears due to an overlap between the two swaths, a next pixel may be from a different image line and it is not possible that a complete image line remains unprinted.

The invention is also embodied in a print system for printing images on an image receiving member in a plurality of swaths, the print system comprising a print head configured to reciprocate in a scanning direction and to apply marking material to the image receiving material in accordance with image data provided to the print head, an image processing module for preparing swath image data from the image, a transport module for advancing the image receiving member stepwise in a transport direction, which is substantially perpendicular to the scanning direction, a processor for defining an advancement step for advancing the image receiving member, a position sensor module for determining a position of a swath on the image receiving member relative to the print head position after advancing the image receiving member, a digital mask module for defining and applying a digital mask to the swath image data in dependence on the determined position of a swath.

Further objects, features and advantages of the method and the print system will be apparent from the more particular description of the exemplary embodiments of the method and the print system, as illustrated in the accompanying drawings in which like reference numbers refer to the same parts throughout the different figures. The drawings are not necessarily to scale, emphasis instead being placed upon illustrating the principle of the method.

BRIEF DESCRIPTION OF THE DRAWINGS

Hereinafter the present invention is further elucidated with references to the appended drawings showing non-limiting embodiments and wherein.

DETAILED DESCRIPTION OF EMBODIMENTS

Figure 1:
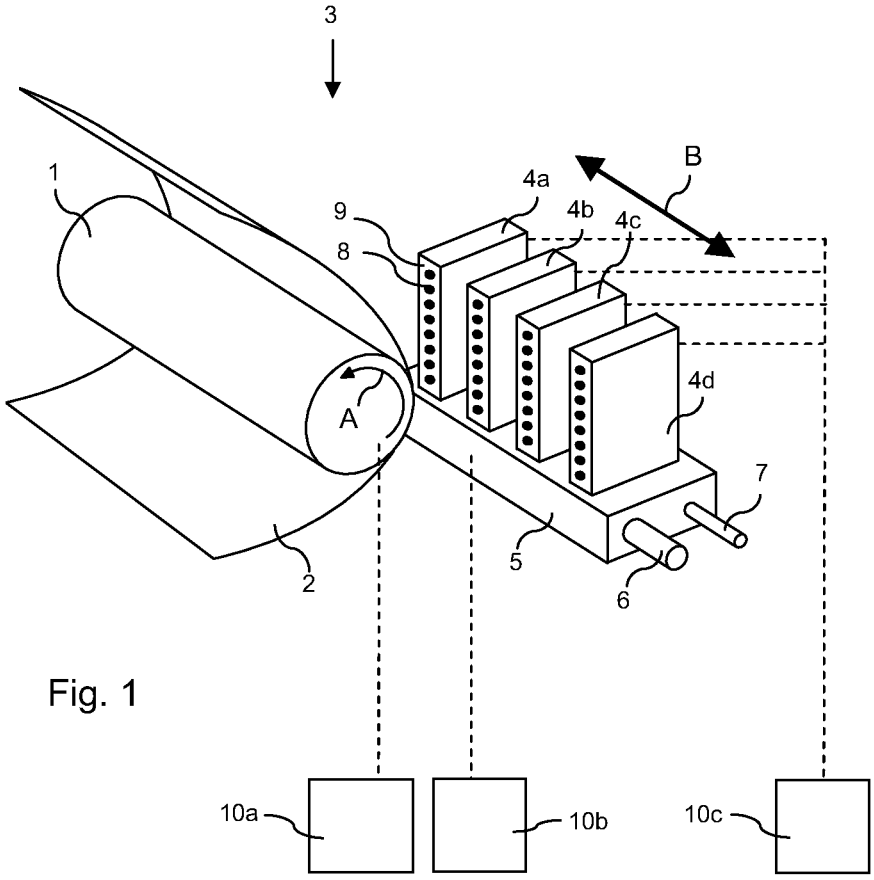
FIG. 1 shows an ink jet printing assembly for application of the invented method.

FIG. 1 shows an ink jet printing assembly 3 that may be applied for the invented method. The ink jet printing assembly 3 comprises supporting means for supporting an image receiving member 2. The supporting means are shown in FIG. 1 as a platen 1, but alternatively, the supporting means may be a flat surface. The platen 1, as depicted in FIG. 1, is a drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the transport direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice, an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1. The rods may be driven by suitable driving means (not shown). Alternatively, the carriage 5 may be guided by other guiding means, such as an arm being able to move the carriage 5. Another alternative is to move the image receiving material 2 in the main scanning direction B. Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction, or transport direction, A. Eight orifices 8 per print head 4*a*-4*d* are depicted in FIG. 1, however, obviously in a practical embodiment several hundreds of orifices 8 may be provided per print head 4*a*-4*d*, optionally arranged in multiple arrays. As depicted in FIG. 1, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively, multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8. Attached to the carriage may also be a sensor (not shown), preferably an optical sensor module, that is used to measure a position of a first swath while printing a second swath.

Figure 2:
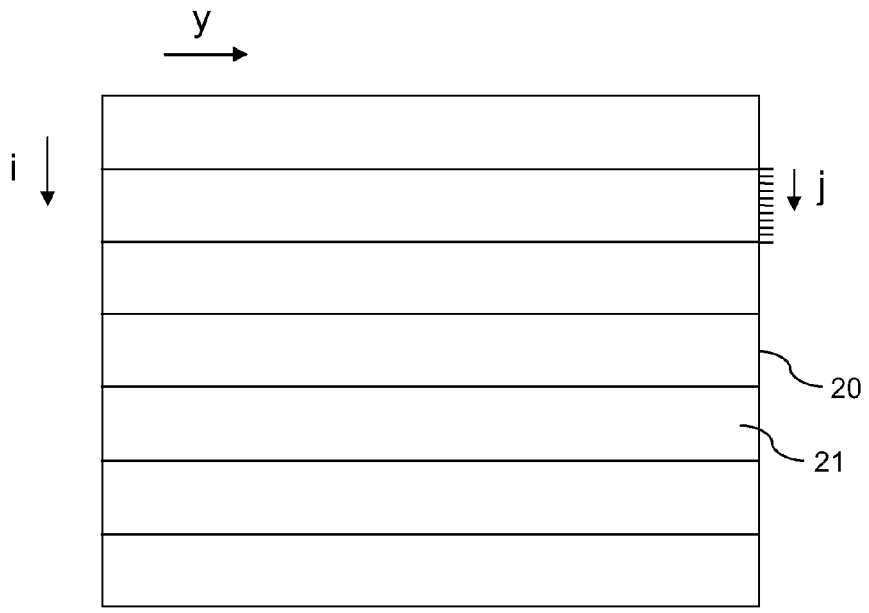
FIG. 2 shows the orientation of the swaths in the image.

FIG. 2 shows a division of an image area 20 in individual swaths 21. Indicated are a direction for numbering the swaths, i, and a numbering image lines within a swath, j, each image line being associated with a print element having an orifice 8 in FIG. 1. Both directions are parallel to the transport direction A in FIG. 1 of an image receiving medium 2. Further is indicated a direction, y, parallel to the scanning direction B in FIG. 1, which is used to define a position of a pixel on an image line within a swath.

Figure 3:
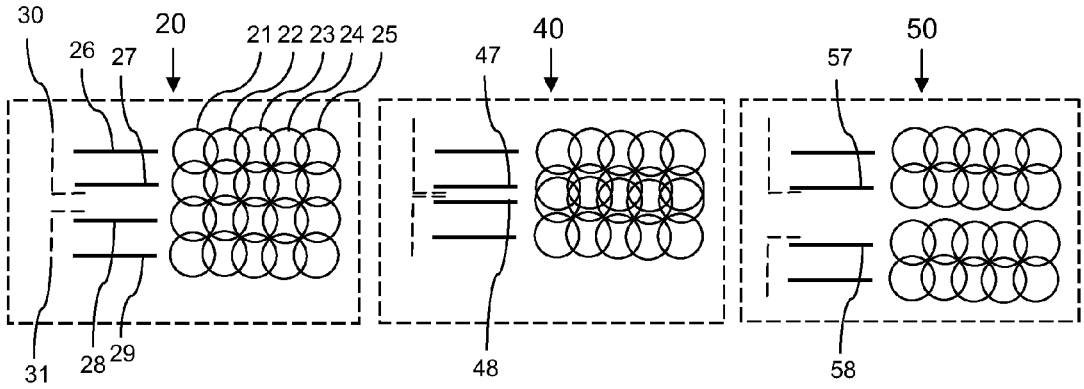
FIG. 3 illustrates the formation of image lines and the boundary effect.

In FIG. 3 the formation of image lines and the boundary effect are shown as they are known in the art. The first situation, 20, indicates a series of dots 21, 22, 23, 24, 25 that result in image line 26. Similarly, image line 27 is formed at a lower end of a print head in a position indicated by 30. After a paper step that brings an upper end of the print head in a position indicated by 31, image lines 28 and 29 are printed close to the earlier printed image lines 26 and 27. When the advancement of the paper is correct, the distance between the image lines 27 and 28 is equal to the distance between 26 and 27 and to the distance between 28 and 29. In this case, no boundary effect will be visible. The second situation, 40, shows the same series of dots forming image lines at the two ends of a print head, but in this case the advancement of the paper is a little too small, making the distance between the image lines 47 and 48 substantially smaller than the distance between the other image lines. In this case, a boundary effect will show as a dark line at the boundary of two swaths. The third situation, 50, refers to the case in which the advancement of the paper is a little too large, making the distance between the two image lines 57 and 58 substantially larger than the distance between the other image lines. Hence, a light line will appear as a boundary effect between the two swaths.

Figure 4A:
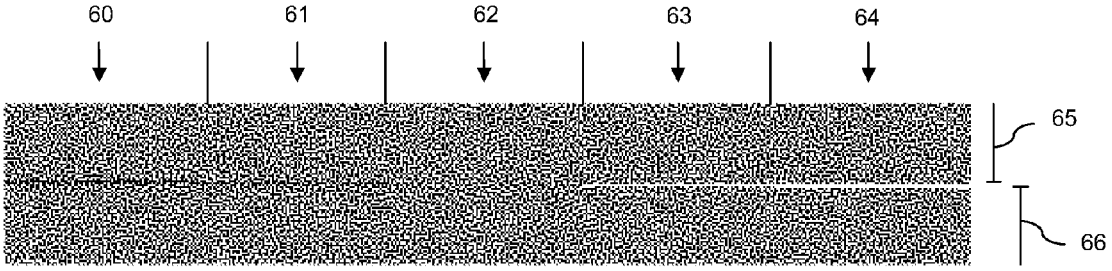
FIG. 4A shows the effect of overlapping swaths for straight edges.

FIG. 4A shows an expanded view of a simulation of the output of a print system in which two swaths of an arbitrary image pattern are printed with a paper step error. In a first part, 60, the two swaths are printed with a paper step that is two image lines too small, in a second part, 61, the paper step is one image line too small, in a third part, 62, the paper step is exactly right, in a fourth part, 63, the paper step is one image line too large and in a fifth part, 64, the paper step is two image lines too large. The dark line in the first two parts, 60 and 61, and the light line in the last two parts, 63 and 64, are the result of a paper step error and should be as little visible as possible. The position of the print head during the printing of the first swath is indicated by the symbol 65 and the position of the print head during the printing of the second swath is indicated by the symbol 66. Note that no overlap is intended between these print head positions.

Figure 4B:
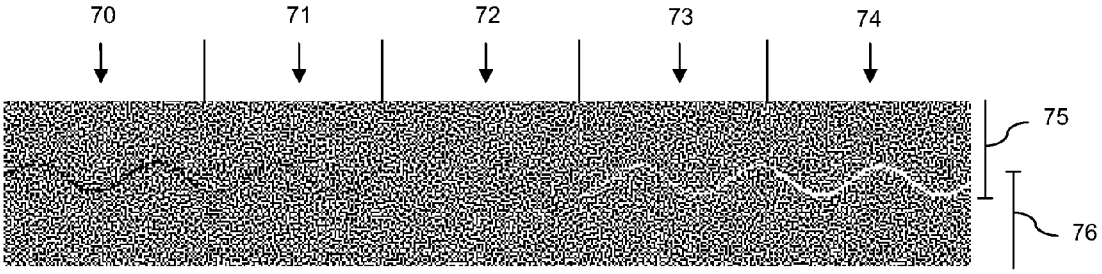
FIG. 4B shows the effect of overlapping swaths using an interweaving technique.

FIG. 4B shows a similar expanded view as FIG. 4A in the situation an interweaving technique is applied. In this case, the position of the print head during the printing of the first swath, indicated by 75, overlaps with the position of the print head during the printing of the second swath, 76. A y-position dependent digital mask is applied to the print signal for a number of print elements in a first swath and a complementing digital mask is applied to the signal for the overlapping nozzles is the second swath. In the illustrated embodiment, the digital mask causes a sinusoidal boundary line that proves to be less annoyingly visible in hot-melt ink deposition processes. Again, five paper step situations are shown, with a paper step that is two image lines too small, 70, one image line too small, 71, exactly right, 72, one image line too large, 73, and two image lines too large, 74. For other print processes, different shapes may be more suitable.

Figure 5:
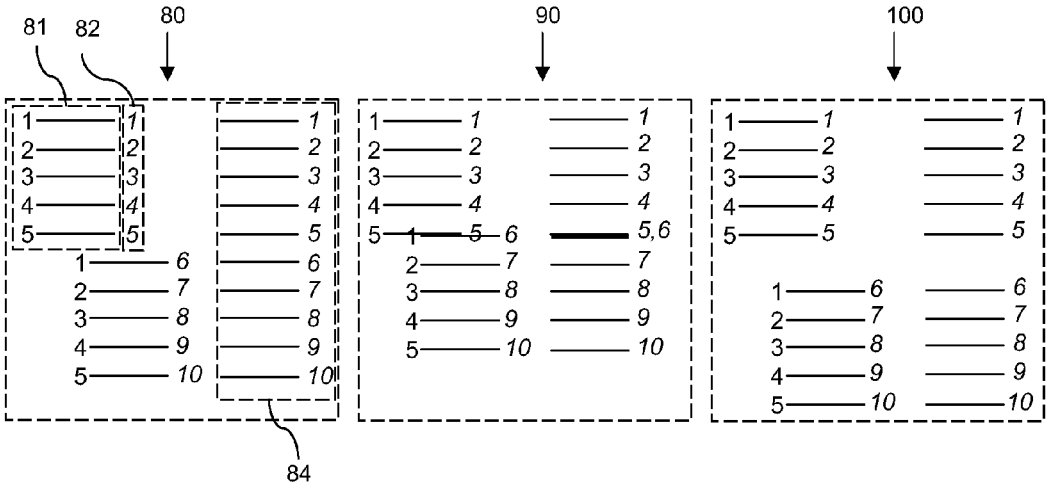
FIG. 5 illustrates a relation between image lines and print elements as in the prior art.

FIG. 5 illustrates a relation between image lines and print elements as used in the situations of FIG. 3 and FIG. 4A. In a first situation, 80, image lines are shown as printed by a print head comprising five print elements. Numbers of the print elements are displayed to the left of the image lines in box 81. Associated with the print elements are five image lines that have numbers as shown at the right side of the image lines in box 82. After a paper step has been made, a second swath is printed with the print elements associated to other image lines. The result of the image lines printed in the two swaths is shown in box 84. In this case, the advancement of the paper is correct, making the distance between all image lines the same. In a second situation, 90, the advancement of the paper is too small, with the result that image lines 5 and 6 are printed on top of each other and show as a dark line at the boundary of the two swaths. In a third situation, 100, the advancement of the paper is too large and a light line appears at the boundary of the two swaths.

Figure 6:
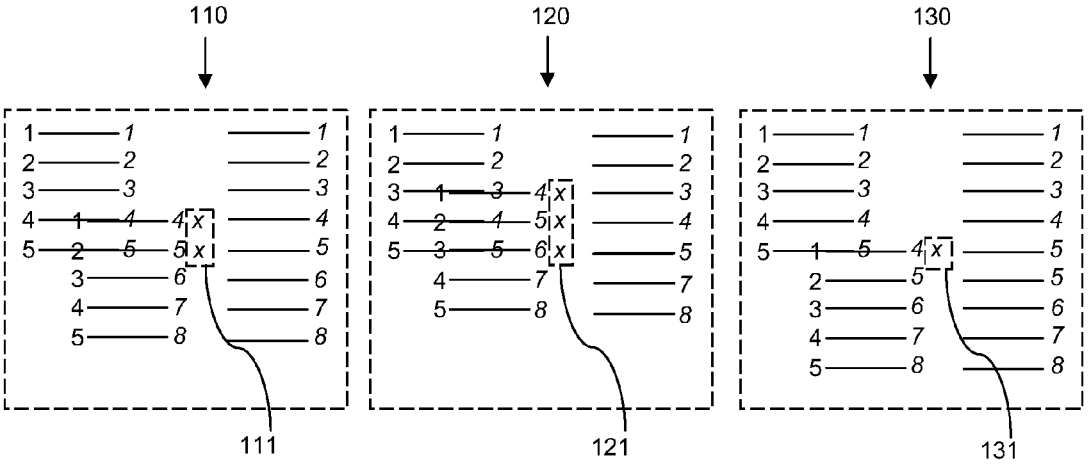
FIG. 6 illustrates a relation between image lines and print elements according to the present invention.

FIG. 6 illustrates a relation between image lines and print elements according to the present invention. As an extra element a digital mask, indicated by 'x' in 111 is introduced. As an example in a first situation, 110, the print elements are associated with the same image lines for a first swath as in the first situation, 80, in FIG. 5. However, for the second swath two image lines are associated again to different print elements. When the advancement of the paper is correct, a digital mask will block the application of marking material from these print elements during printing of the second swath. Therefore, the printed image will look similar to the result in FIG. 5. In a second situation, 120, the advancement of the paper is too small and the definition of the digital mask is extended, as is indicated by the extra 'x' in 121. In the result, an image line is missing, but no dark line will appear. In a third situation, 130, the advancement of the paper is a too large and the digital mask is diminished, as is indicated by the 'x' in 131, with the result that an image line, image line 5, is printed twice, but no light line appears at the boundary of the two swaths.

Figure 7:
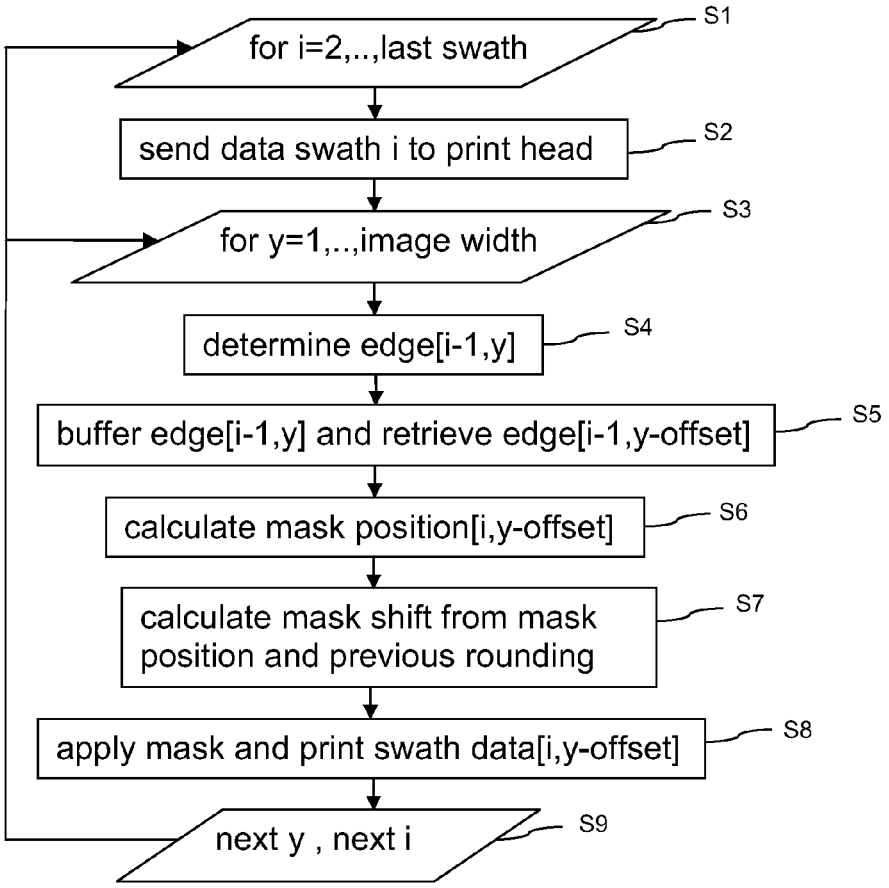
FIG. 7 is a flow chart of an embodiment of the invention.

FIG. 7 is a flow chart of an embodiment of the invention. The very first swath of the image does not have a previous swath to adjoin. Therefore, in step S1 the swath number "i" starts to run from 2 for the second swath to be printed and runs up to the last swath. The number of swaths is related to the height of the image. In a next step, S2, the swath data are sent to the print head for the current swath "i". Then, in step S3, the position in the scanning direction "y" is numbered in accordance with the firing pulse clock of the deposition process from a first position to a position corresponding to the width of the image. At each position "y" the edge of the previous swath "i-1" is determined in S4 and the number of image lines that are to be masked is calculated in S6. This number of image lines, or mask position, is calculated for a position "y minus offset", in which "offset" represents the distance between the position in "y" direction, where the edge of the previous swath is measured, and the position of the print head, where the current swath "i" is printed. The distance "offset", which may be in the order of some centimeters, is sufficient to prepare the masked signal for printing. In an assembly of single print heads, the "offset" varies with the single print head. Therefore, the measurements of the edge are buffered in S5. In S7 the mask shift, which is an integer indicating the number of lines to be masked, is calculated from the mask position and a previous rounding error. The mask position is not necessarily an integer. The previous rounding error is the difference between the mask position and the mask shift at the previous "y-offset" position. By comprising this rounding error the number of lines that is masked is on the average corresponding to a fractional determined mask position. The applied digital mask may thus be thought of as comprising two masks each corresponding to an integral number of image lines, being the integers that are closest to the calculated mask position. After applying the defined digital mask to the swath data for the position "y-offset" and printing these data in S8, the same steps are followed for a next "y" position in S9, depending on the autonomous movement of the print head.

After finishing swath "i", the same procedure is followed for the next swath. This method may well be implemented in a Field Programmable Gate Array that is combined with the print head electronics to obtain a sufficiently fast processing time.

Figure 8:
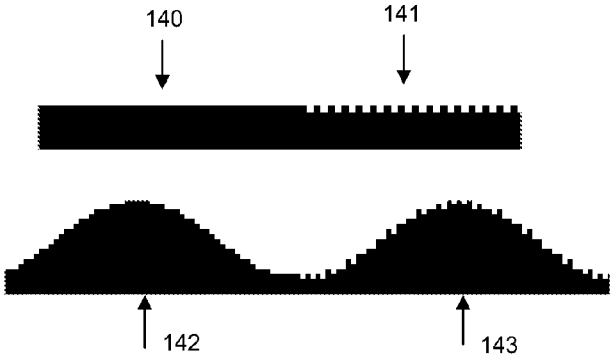
FIG. 8 is an example of a number of digital mask sequences.

FIG. 8 illustrates four examples of digital mask sequences. The black area represents the blocking area for image lines. When the number of image lines that is blocked, is an integer for a number of subsequent positions in the "y" direction, the digital mask that is applied to the swath data is the same and a constant sequence occurs, as in 140. In contrast, a fractional number of image lines, shown in 141 for a half image line, result in a mask dithering between two positions, in this case half of the times rounded down and half of the times rounded up. Both situations may be combined with an sinusoidal interweaving digital mask, as in 142 for an integral number of image lines and in 143 for a fractional number of image lines, as shown for a half image line.

Figure 9:
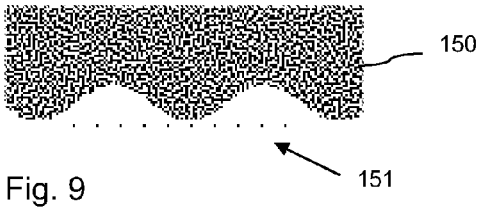
FIG. 9 shows a position of markers at the boundary of a first swath.

FIG. 9 shows a possible position of a marker 151 at the edge of a first swath 150 with the application of an interweaving mask. The marker is added to the swath data at a number of "y" positions in order for a sensor to detect the edge of the swath. At "y" positions where no marker is printed, the edge position may be determined by extrapolation of previous measurements. The marker is preferably printed with a light ink, such as yellow ink, because in that way the markers will disturb the printed image as little as possible.

Figure 10:
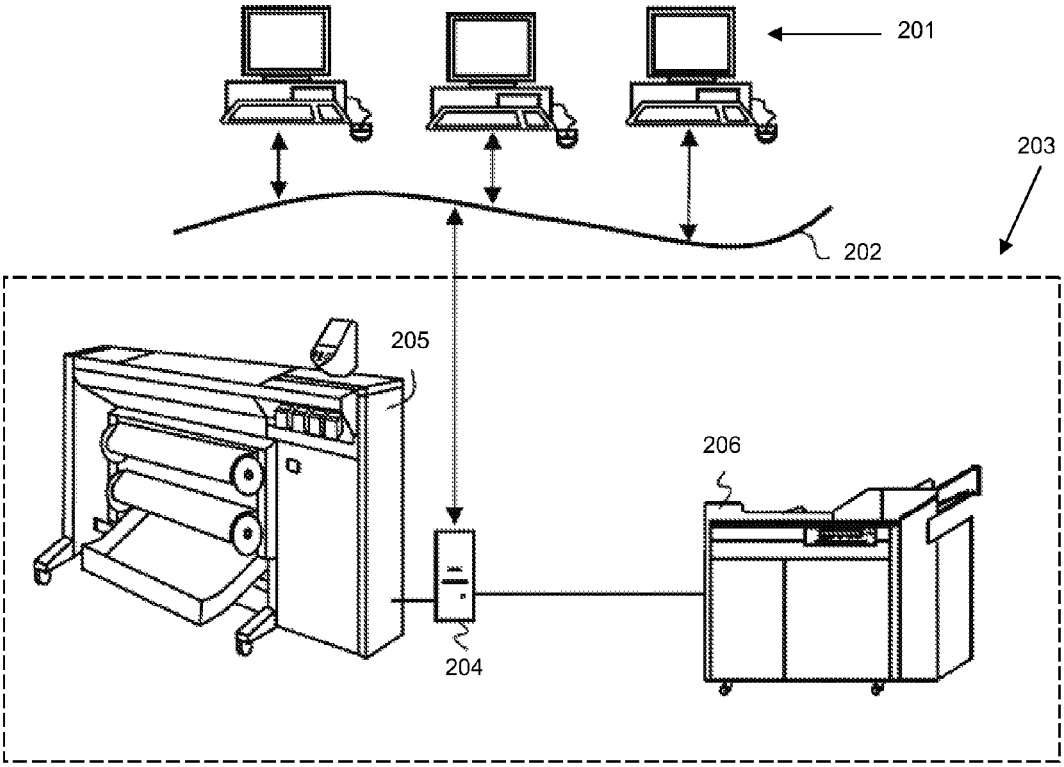
FIG. 10 is a print system in which the invention is applied.

FIG. 10 is a print system in which the invention is applied. From a workstation or personal computer 201, that is, whether or not wirelessly, connected to a network 202, a print job may be submitted to be printed by the print system 203. A controller 204 is configured to accept print jobs, select an appropriate print engine and prepare the print job for printing by converting the images from the print job to printable pages. Already in the controller 204 the printable page may be divided in swaths and print signals may be derived from the image. Alternatively, the printable page is sent to the appropriate printer 205 or 206, dependent on the size of the image or on the use of color in the image or any other different feature of a printer connected to the controller 204, and the print signals are derived by an engine controller (not shown), that is configured to control the behavior of the print engine. The definition of a digital mask is preferably done by the engine controller, as it depends on a measurement of a position of a swath, as accomplished in the print engine.

The above disclosure is intended as merely exemplary, and not to limit the scope of the invention, which is to be determined by reference to the following claims.

The invention claimed is:

1. A method for printing an image on an image receiving member in a plurality of swaths, each swath being printed by a print head that reciprocates in a scanning direction, the print head being configured to apply marking material to the image receiving member in accordance with image data provided to the print head and the image receiving member being advanced stepwise in a transport direction, which is substantially perpendicular to the scanning direction, the method comprising the steps of:

a) preparing first swath image data from the image, the first swath image data comprising image data to print a first swath;

b) printing the first swath using the first swath image data by the application of a selected part of the print head;

c) defining an advancement step for advancing the image receiving member, such that, after application of the advancement step, at least a part of the print head overlaps the first swath;

d) preparing second swath image data from the image, based on the defined advancement step, the second swath image data comprising image data to print a second swath and comprising at least a part of the first swath image data;

e) advancing the image receiving member in the transport direction using the advancement step;

f) determining a position of the first swath on the image receiving member relative to the print head position after advancing the image receiving member;

g) defining, in dependence on the determined position, a digital mask that prevents the application of the part of the print head that overlaps the first swath, the digital mask only being able to block or not block an application of marking material; and h) printing a second swath with the application of the digital mask on the second swath image data without changing a positional relation between the second swath image data and the print head.

2. The method according to claim 1, wherein the steps of determining a position of the first swath on the image receiving member relative to the print head position after advancing the image receiving member and defining a digital mask depend on a position of the print head in the scanning direction.

3. The method according to claim 1, wherein the step of determining a position of the first swath is executed during a scanning movement for printing the second swath.

4. The method according to claim 3, wherein determining a position of the first swath is done using a sensor that is attached to a mechanical structure comprising the print head.

5. The method according to claim 1, wherein defining an advancement step is based on a measurement of a distance between two swaths.

6. The method according to claim 1, wherein the digital mask comprises two digital masks that are applied alternately when the part of the print head that overlaps the first swath does not correspond to an integral number of image lines.

7. The method according to claim 1, wherein a digital mask is applied for interweaving the first and second swath and a position of the digital mask is adapted to the determined position of the first swath.

8. The method according to claim 1, wherein the position of the first swath on the image receiving member is determined by a marker that is printed during printing the first swath and wherein marker image data are added to the first swath image data for printing the marker during printing the first swath.

9. The method according to claim 8, wherein the marker is printed with an ink from an available set of inks, the ink being selected for having the largest lightness.

10. The method according to claim 8, wherein at least three markers are printed during the printing of the first swath.

11. A print system for printing images on an image receiving member in a plurality of swaths, the print system comprising:

a print head configured to reciprocate in a scanning direction and to apply marking material to the image receiving material in accordance with image data provided to the print head;

an image processing module for preparing swath image data from the image;

a transport module for advancing the image receiving member stepwise in a transport direction, which is substantially perpendicular to the scanning direction;

a processor for defining an advancement step for advancing the image receiving member, a position sensor module for determining a position of a swath on the image receiving member relative to the print head position after advancing the image receiving member; and a digital mask module for defining and applying a digital mask to the swath image data in dependence on the determined position of a swath, the digital mask only being able to block or not block an application of marking material, wherein the image processing module prepares first swath image data comprising image data to print a first swath from the image and second swath image data comprising image data to print a second swath from the image, the second swath printed without changing a positional relation between the second swath image data and the print head.

12. The print system according to claim 11, wherein the position sensor module is attached to the print head for determining a position of a swath on the image receiving member relative to the print head position during the printing of a next swath.

13. The print system according to claim 11, wherein the system further comprises an averaging module for calculating an advancement step from a measurement of the position of a swath on the image receiving member relative to the print head position during the printing of a next swath.

14. A method for printing an image on an image receiving member in a plurality of swaths, each swath being printed by a print head that reciprocates in a scanning direction, the print head being configured to apply marking material to the image receiving member in accordance with image data provided to the print head and the image receiving member being advanced stepwise in a transport direction, which is substantially perpendicular to the scanning direction, the method comprising the steps of:

a) preparing first swath image data from the image, the first swath image data comprising image data to print a first swath;

b) printing the first swath using the first swath image data by the application of a selected part of the print head;

c) defining an advancement step for advancing the image receiving member, such that, after application of the advancement step, at least a part of the print head overlaps the first swath;

d) preparing second swath image data from the image, based on the defined advancement step, the second swath image data comprising image data to print a second swath and comprising at least a part of the first swath image data;

e) advancing the image receiving member in the transport direction using the advancement step;

f) determining a position of the first swath on the image receiving member relative to the print head position after advancing the image receiving member;

g) defining, in dependence on the determined position, a digital mask that prevents the application of any marking material from the part of the print head that overlaps the first swath; and h) printing a second swath with the application of the digital mask on the second swath image data.

* * * * *